US006419194B1

(12) United States Patent
LoSacco et al.

(10) Patent No.: US 6,419,194 B1
(45) Date of Patent: Jul. 16, 2002

(54) PAINT BRUSH HOLDER

(75) Inventors: Vincent J. LoSacco, 319 Lambert Ave., Northvale, NJ (US) 07647; Daniel C. Notarnicola, Middletown, NJ (US)

(73) Assignee: Vincent J. LoSacco, Northvale, NJ (US)

( * ) Notice: Subject to any disclaimer, the term of this patent is extended or adjusted under 35 U.S.C. 154(b) by 0 days.

(21) Appl. No.: 09/602,737

(22) Filed: Jun. 23, 2000

(51) Int. Cl.[7] ..... A46B 17/02

(52) U.S. Cl. ..... 248/113; 248/110; 248/111; 248/316.7

(58) Field of Search ..... 248/110, 111, 248/113, 312.1, 37.6, 231.81, 316.7, 295.11, 316.4, 292.12

(56) References Cited

U.S. PATENT DOCUMENTS

| | | | | | |
|---|---|---|---|---|---|
| 1,290,072 | A | * | 1/1919 | Bullock | 248/231.2 |
| 1,622,058 | A | * | 3/1927 | Sohnle | 248/231.2 |
| 1,848,450 | A | * | 3/1932 | Williamson | 248/231.2 |
| 2,184,667 | A | | 12/1939 | Hannan | |
| 2,315,269 | A | | 3/1943 | Morgillo | |
| 2,454,474 | A | | 11/1948 | Nance | |
| 2,489,875 | A | | 11/1949 | Embree | |
| 2,625,299 | A | | 1/1953 | Uhlig | |
| 2,855,123 | A | | 10/1958 | Kintz | |
| 2,906,124 | A | * | 9/1959 | Chaney | 248/231.2 |
| 3,531,073 | A | * | 9/1970 | Cortina | 248/113 |
| 4,116,332 | A | | 9/1978 | Hartley | |
| 4,121,798 | A | | 10/1978 | Schumacher et al. | |
| 4,266,686 | A | * | 5/1981 | Carter | 220/90 |
| 4,991,803 | A | | 2/1991 | Buder | |
| 5,087,014 | A | * | 2/1992 | Desjardin | 248/692 |
| 5,375,736 | A | * | 12/1994 | Gonzalez et al. | 220/697 |
| 5,383,793 | A | * | 1/1995 | Hsu et al. | 439/327 |
| 5,806,818 | A | * | 9/1998 | Heywood | 248/213.2 |
| 5,996,952 | A | * | 12/1999 | Heywood | 248/231.2 |

* cited by examiner

*Primary Examiner*—Anita King
*Assistant Examiner*—Kimberly Wood
(74) *Attorney, Agent, or Firm*—Arthur Jacob

(57) ABSTRACT

A pain brush holder has a basal member curved to follow the curve of the rim of a paint container to which the paint brush holder is attached by depending clamp jaws spaced apart circumferentially along the curve of the basal member. A clip member has a depending shaft extending through a guideway in the basal member and clip jaws for holding a paint brush over the interior of the container. Complementary detents secure the clip member within the basal member at a selected altitudinal location so as to maintain the paint brush at a selected elevation within the interior of the container.

16 Claims, 7 Drawing Sheets

PAINT BRUSH HOLDER

The present invention relates generally to painting aids and pertains, more specifically, to a paint brush holder for holding a paint brush suspended in a generally vertical orientation and at a selected altitudinal elevation over the interior of a paint container.

One of the most common and persistent dilemmas faced by individuals who utilize a paint brush to spread paint supplied to the brush from a paint container, such as a paint can or a paint pail, is placement of the paint brush at rest during those periods when painting with the paint brush is interrupted. Usually, such an individual will place the paint brush in or on the container, either oriented vertically, with the bristles of the brush resting against the bottom of the container, or oriented horizontally, with the bristles resting against the rim of the container.

Resting the paint brush in the described vertical orientation can result in the bristles being bent by the weight of the brush, causing permanent damage to the bristles and seriously diminishing the effectiveness of the brush. Moreover, depending upon the depth of paint in the container, the handle of the brush can become immersed in paint, leading to a messy and wasteful follow-up procedure, or the bristles can be exposed, allowing the formation of hardened paint on the bristles, with concomitant diminished brush performance.

Resting the paint brush in the described horizontal orientation exposes the bristles fully to ambient air, allowing the brush to dry out and become essentially useless. In addition, paint can drip from the bristles to the vicinity outside the container, leading to a paint-laden exterior on the container and a messy site.

A wide variety of paint brush holders have been offered over the years in an effort to obviate the problems outlined above. However, these prior devices have been found to exhibit one or more of several drawbacks, namely: they are relatively difficult to attach to and to detach from a paint container, sometimes requiring complex manipulations for proper placement; they are not secure and are unstable when attached to a container; they are designed for a specific can or pail configuration and are not readily adapted to the variety of configurations encountered in the field; they do not allow easy compensation for the level of paint in a container; they are generally cumbersome in construction and awkward in use; they are not economically manufactured and distributed for sale and, consequently, are not offered for sale at a price which most consumers would find attractive.

The present invention provides a paint brush holder having a construction and performance characteristics which alleviate the above-outlined problems. As such, the paint brush holder of the present invention attains several objects and advantages, some of which are summarized as follows: Provides a paint brush holder having a construction adapted for attachment to any one of the several commonly available paint container configurations without requiring modification of the paint brush holder structure; enables secure and stable attachment of the paint brush holder to a container with ease while allowing ready selective detachment; does not interfere with the conduct of normal painting operations; holds a paint brush in a desired vertical orientation over the interior of a paint container at an altitudinal elevation selected in accordance with the level of paint in the container so as to enable suspension of the brush above the paint or, if immersion is desired, to assure appropriate immersion of the bristles of the brush without unwanted bending of the bristles or submersion of the brush handle; provides a brush holder constructed of a minimal number of component parts which are readily manufactured and easily assembled for use in the field; attains ease of use and subsequent clean-up through simplified component parts which are easily assembled for use and disassembled subsequent to use; allows ease of packaging and distribution for enhanced and economical distribution and sale; provides a rugged construction capable of exemplary performance over a long service life.

The above objects and advantages, as well as further objects and advantages, are attained by the present invention which may be described briefly as a paint brush holder for holding a paint brush suspended in a generally vertical orientation over an interior of a container having an essentially cylindrical wall with a rim following a curve along the cylindrical wall, an exterior surface and an interior surface, the paint brush holder being adapted for attachment to the container at the curved rim of the container, the paint brush holder comprising: a basal member extending longitudinally and having altitudinally depending clamp jaws located along a basal curve generally concentric with the curve of the rim of the container, and a support extending laterally for location over the interior of the container when the basal member is placed over the curved rim of the container; and a clip member on the support, the clip member having clip jaws for holding the paint brush in the vertical orientation, the clip jaws extending laterally relative to the support for suspending the paint brush over the interior of the container; the clamp jaws including first clamp jaws spaced apart along the basal curve for engaging one of the interior and exterior surfaces of the container, and at least one second clamp jaw located along the basal curve for engaging the other of the interior and exterior surfaces such that the first and second clamp jaws will attach the basal member in place along the rim of the container.

The invention will be understood more fully, while still further objects and advantages will become apparent, in the following detailed description of a preferred embodiment of the invention illustrated in the accompanying drawing, in which.

Figure 1:
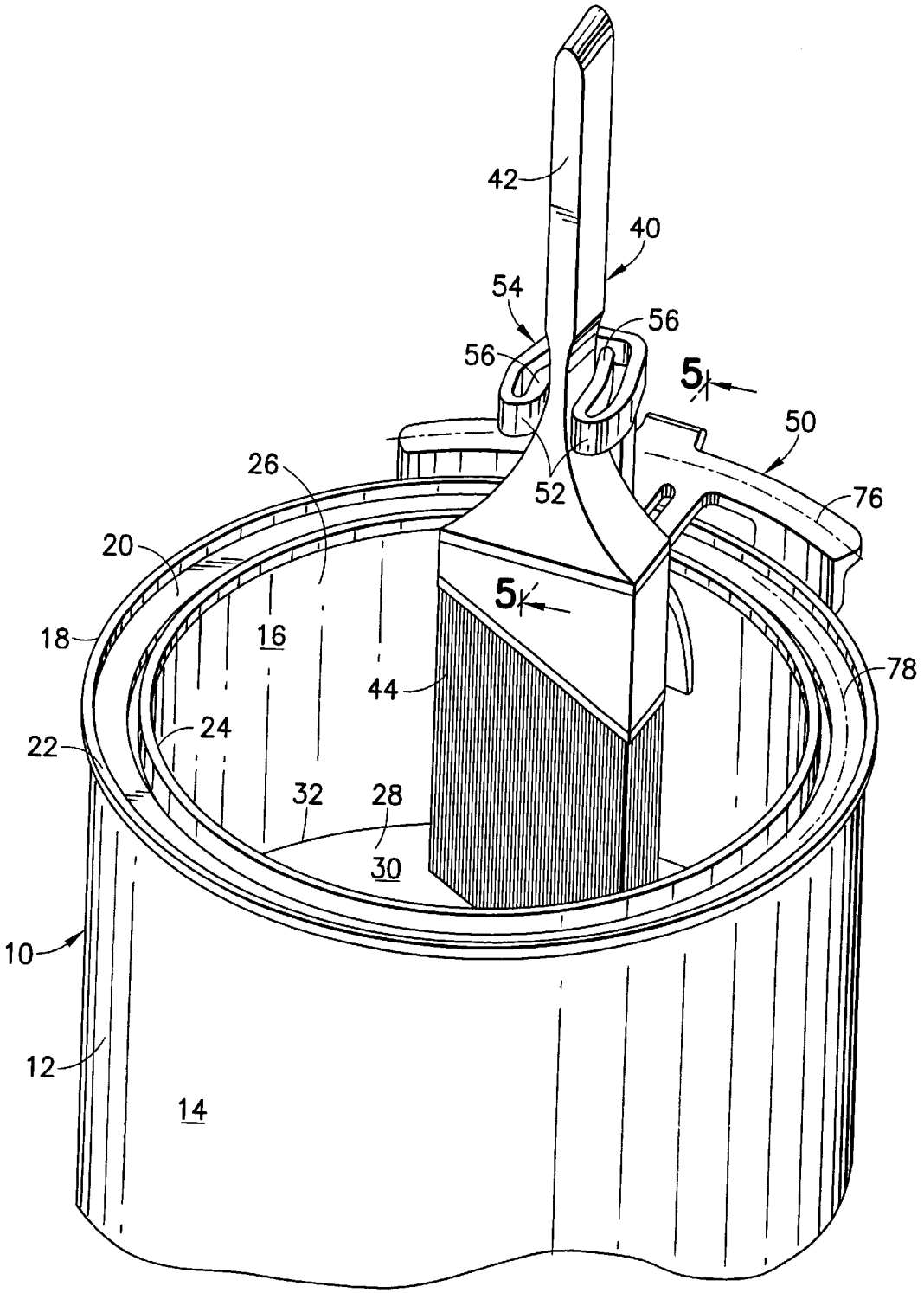
FIG. 1 is a fragmentary pictorial perspective view showing a paint brush holder constructed in accordance with the present invention attached to a conventional paint container and holding a conventional paint brush.

Referring now to the drawing, and especially to FIG. 1 thereof, a paint container is shown in the form of a conventional paint can 10 having a cylindrical side wall 12 including an exterior surface 14 and an interior surface 16. Paint can 10 includes a rim 18 of conventional construction which includes an annular groove 20, an outer flange 22 and an inner flange 24. Paint can 10 has an interior 26 within which paint 28 is contained, paint 28 being illustrated with an upper surface 30 located at a given altitudinal level 32. A conventional paint brush is shown in the form of paint brush 40 having a handle 42 and a plurality of bristles 44 extending from the handle 42. During use of the paint brush 40 in ordinary painting operations, handle 42 is gripped by an individual and the bristles 44 are dipped into the paint 28 for subsequent spreading of the paint 28 upon a surface to be painted (not shown). When the painting operation is interrupted and the individual desires to rest the paint brush 40, the paint brush 40 is placed in paint brush holder 50 constructed in accordance with the present invention. To that end, the handle 42 of the paint brush 40 is inserted between opposed clip jaws 52 of a clip member 54 of the paint brush holder 50 so as to suspend the paint brush 40 over the interior 26 of the paint can 10. Clip jaws 52 provide opposed fingers 56 which are resiliently deflected readily to admit handle 42 between the clip jaws 52 for holding the paint brush 40 securely in place and for easily releasing the paint brush 40 upon demand. The paint brush 40 itself is held in the desired vertical orientation.

Figure 2:
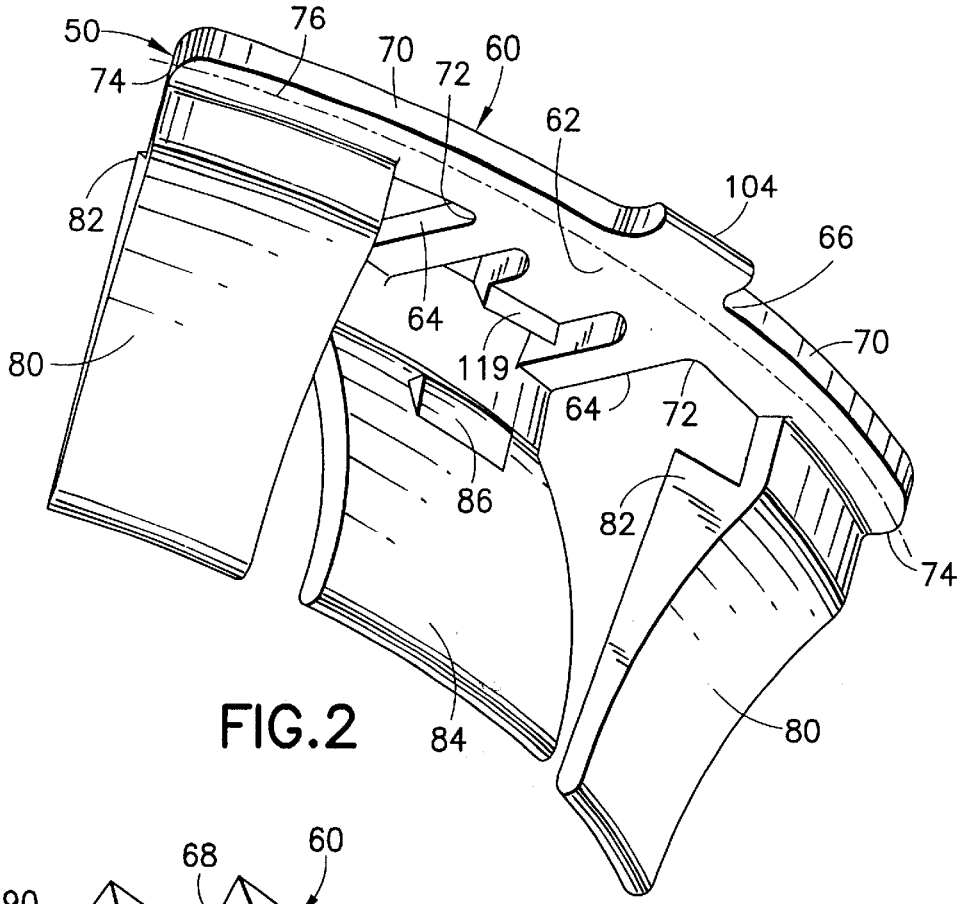
FIG. 2 is an outside and bottom perspective view of a basal component part of the paint brush holder.
Figure 3:
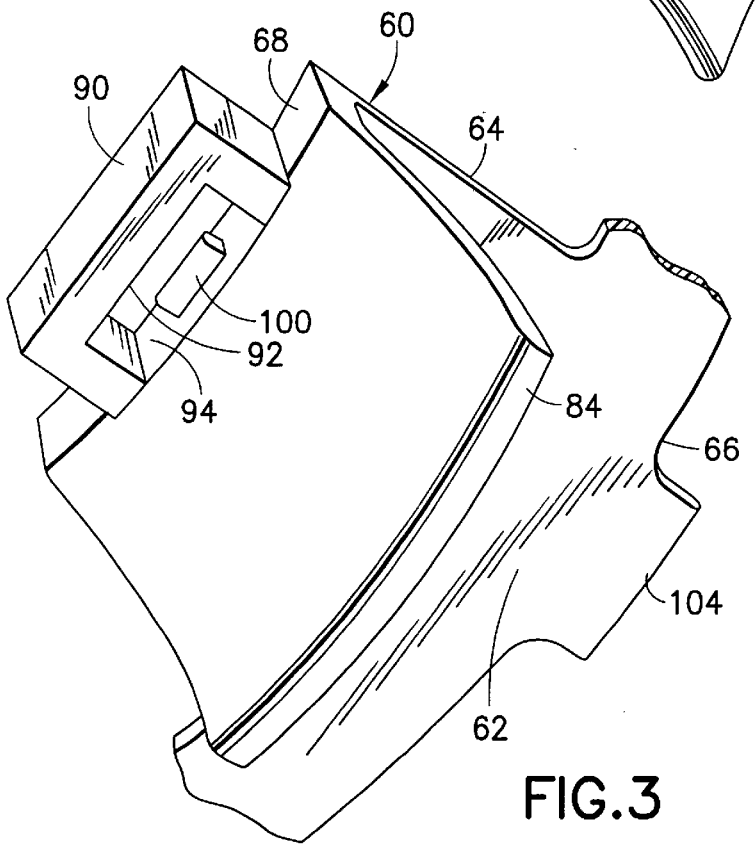
FIG. 3 is a fragmentary inside and bottom perspective view of a portion of the basal component part.
Figure 4:
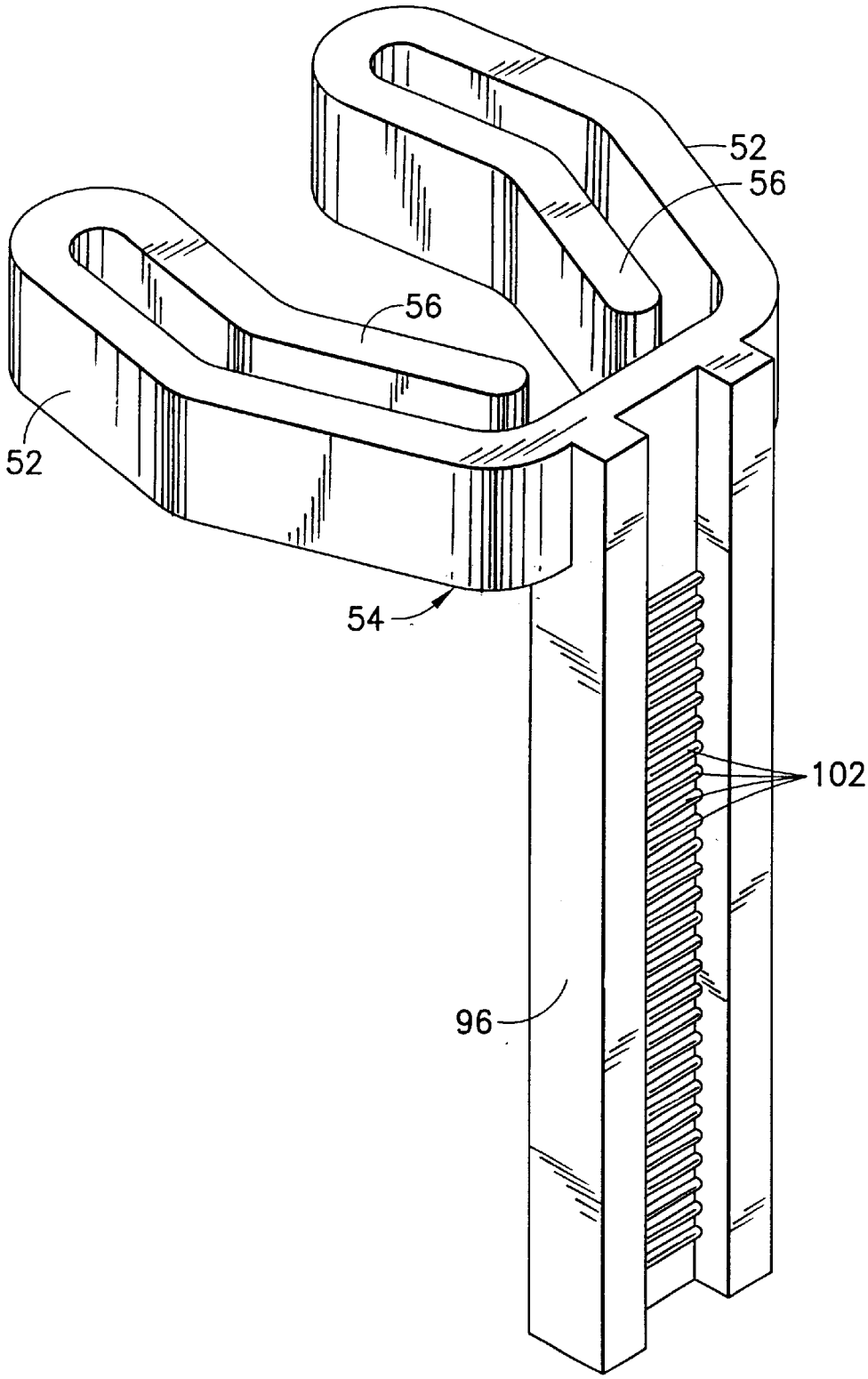
FIG. 4 is an outside and top perspective view of a clip component part of the paint brush holder.

Turning now to FIGS. 2 through 4, as well as to FIG. 1, paint brush holder 50 is seen to include a basal component part shown in the form of basal member 60 extending longitudinally and having a central portion 62 which includes longitudinally opposite sides 64, an outer edge 66 and a laterally opposite inner edge 68. Arcuate arms 70 each project longitudinally from a root 72 located at a corresponding side 64 to a remote tip 74, each arcuate arm 70 following a basal curve 76 which is generally concentric with the cylindrical curve 78 of the rim 18 of the paint can 10. An outer clamp jaw 80 depends from each arcuate arm 70, adjacent the remote tip 74, and carries a barbed element 82. The outer clamp jaws 80 are spaced apart a considerable distance circumferentially along the basal curve 76, by virtue of the location of the clamp jaws 80 adjacent the remote tips 74 of the corresponding arcuate arms 70. An inner clamp jaw 84 depends from the central portion 62, at the inner edge 68, and is located intermediate the outer clamp jaws 80, preferably equidistant from each clamp jaw 80. Inner clamp jaw 84 includes a further barbed element 86. Preferably, the outer clamp jaws 80 and the inner clamp jaw 84 are curved to follow generally the basal curve 76.

As best seen in FIGS. 3 and 4, a support 90 extends laterally inwardly from the inner edge 68 of the central portion 62 of the basal member 60. A guideway 92 extends in an altitudinal direction through the support 90 and is shown in the form of a generally rectangular opening 94 in the support 90. Clip member 54 includes a shaft 96 depending altitudinally from the opposed clip jaws 52. Shaft 96 has a cross-sectional configuration generally complementary to the guideway 92 so that the shaft 96 is received within the guideway 92 for sliding movement in altitudinal directions 98. A detent element 100 extends into guideway 92 and a plurality of complementary detent elements 102 are located along the shaft 96 to establish complementary selective securing elements on the support 90 and on the shaft 96 for securing the shaft 96 within the support 90 with the clip jaws 52 at a selected altitudinal location.

Figure 5:
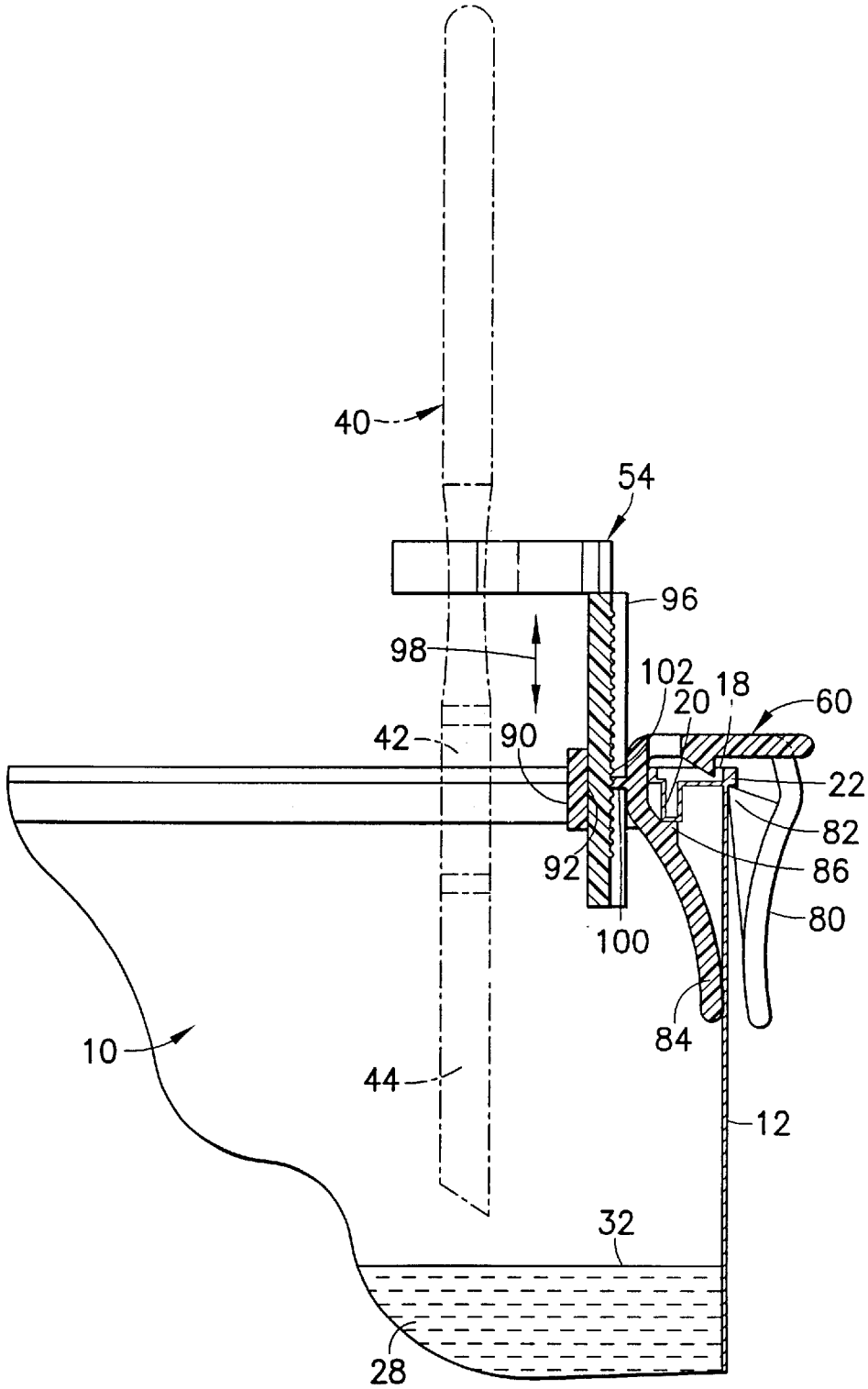
FIG. 5 is a fragmentary cross-sectional view taken along line 5—5 of FIG. 1.

Thus, turning to FIG. 5, with the basal member 60 attached at the rim 18 of the can 10, the shaft 96 is selectively moved in altitudinal directions 98 to place the paint brush 40 at a selected altitudinal level relative to the level 32 of the paint 28 in the can 10 and the selected level is maintained by the engagement of detent element 100 with a selected detent element 102. In the illustration of FIG. 5 the selected level is such that the bristles 44 of the paint brush 40 are suspended above the level 32 of the paint 28 in the can 10, a position suited to short-term resting of the paint brush 40, with any dripping paint being returned to paint 28. When it is desired to rest the paint brush 40 for relatively longer periods, the bristles 44 may be immersed within the paint 28 to deter drying out without submerging the brush handle 42. The ability to move the clip member 54 to selected altitudinal positions enables the above-described selection, as well as ready compensation to accommodate various levels of paint 28 within the can 10.

Basal member 60 preferably is molded in one piece of synthetic polymeric material having a degree of resilience which enables the basal member 60 to be snapped into place over the rim 18 of the can 10, as shown. A suitable and preferred synthetic polymeric material is polypropylene. A finger tab 104 extends from the outer edge 66 of the central portion 62 to assist in the attachment and in the detachment of the basal member 60. When attached, the basal member 60 is provided with added stability by the location of the barbed elements 82 beneath the outer flange 22 and the location of the further barbed element 86 beneath the groove 20 of the rim 18. The stability of the basal member 60 on the rim 18 is greatly enhanced by the span between the outer clamp jaws 80 provided by the placement of the outer clamp jaws 80 at the tips 74 of the corresponding arcuate arms 70. Further, the arcuate arms 70 act as resilient cantilevers enabling ease of attachment and detachment while providing increased stability in connection with intermediate inner clamp jaw 84, the outer clamp jaws 80 and the inner clamp jaw 84 establishing a secure, three-point grip on the side wall 12 of can 10. In addition, the flexibility of the cantilever arcuate arms 70 facilitates conformance of basal member 60 to variations which may be found in the configuration of paint containers encountered in the field.

Clip member 54 advantageously is molded in one piece of a synthetic polymeric material having a degree of resilience which enables the fingers 56 of clip jaws 52 to accept paint brush handles of various sizes and configurations. A preferred synthetic polymeric material is polypropylene. In order to accommodate very large variations in paint brush sizes and configurations, paint brush holder 50 may be supplied with alternate clip members 54 having clip jaws 52 of different dimensions, while maintaining the same cross-sectional dimensions for the shaft 96. In this manner, selection of an appropriate clip member 54 enables a user to accommodate a paint brush 40 of any size or dimension. It has been found that essentially all of the most common paint brushes 40 can be accommodated by the selection of one of only two different sizes of clip members 54.

Figure 6:
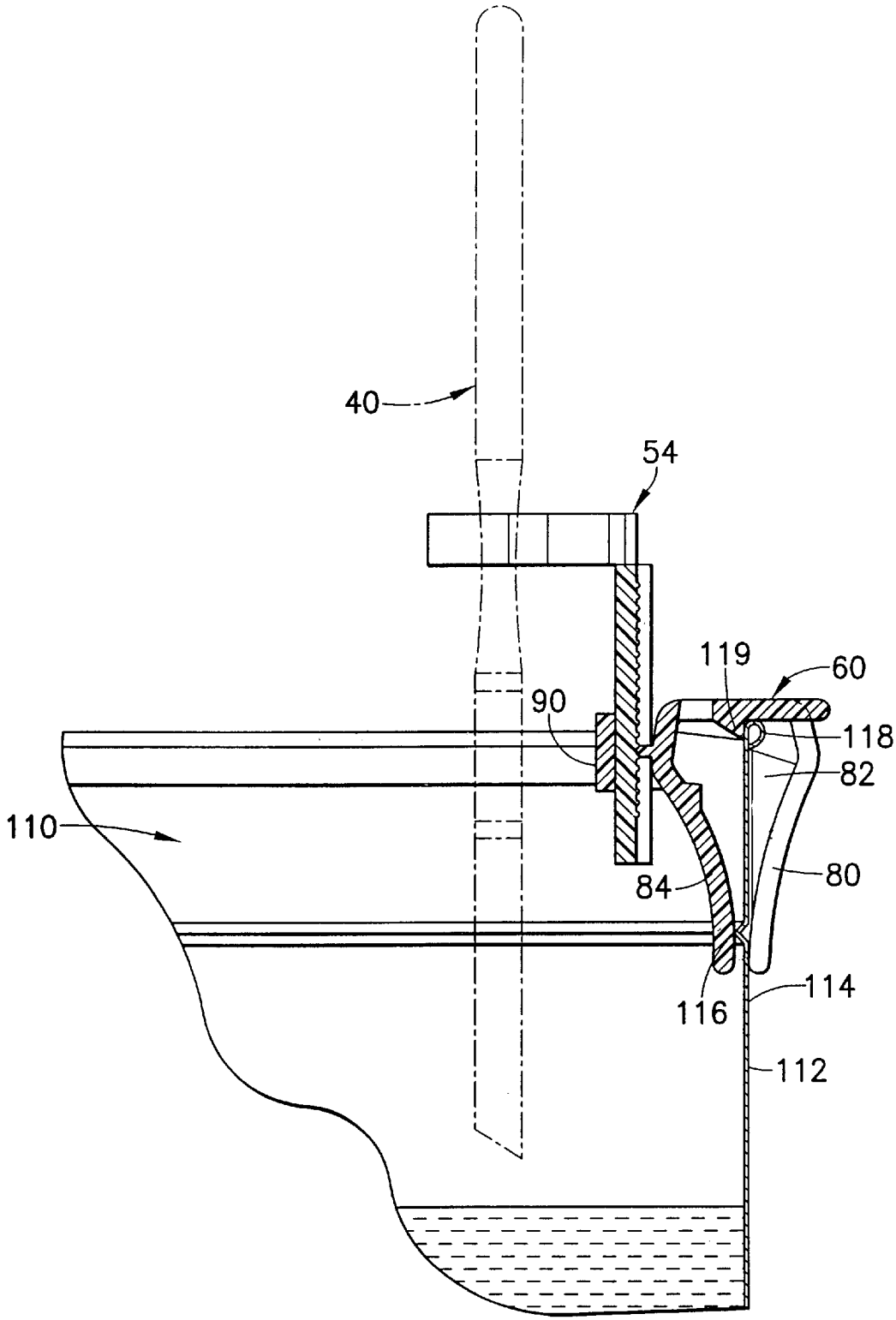
FIG. 6 is a fragmentary cross-sectional view similar to FIG. 5, and showing an alternate paint container.

Turning now to FIG. 6, an alternate container is shown in the form of a paint pail 110 having a generally cylindrical side wall 112 and a beaded rim 118. The basal member 60 readily adapts to the rim 118 of pail 110 by virtue of the arrangement of clamp jaws 80 and 84 along the basal curve 76. In this instance, the outer clamp jaws 80 engage the exterior surface 114 of the pail 110, with barbed elements 82 beneath the beaded rim 118, and the intermediate clamp jaw 84 engages the interior surface 116, with the resilience of the material of the basal member 60 and the span established by the spacing between the outer clamp jaws 80 along the basal curve 76 providing the requisite combination of stability and ease of attachment and detachment along with the ability to compensate for variations in container configuration so as to render paint brush holder 50 truly universal. In order to further enhance the stability of basal member 60 when attached to pail 110, as shown, a supplemental tang 119 depends from central portion 62 and engages the interior of rim 118.

Figure 7:
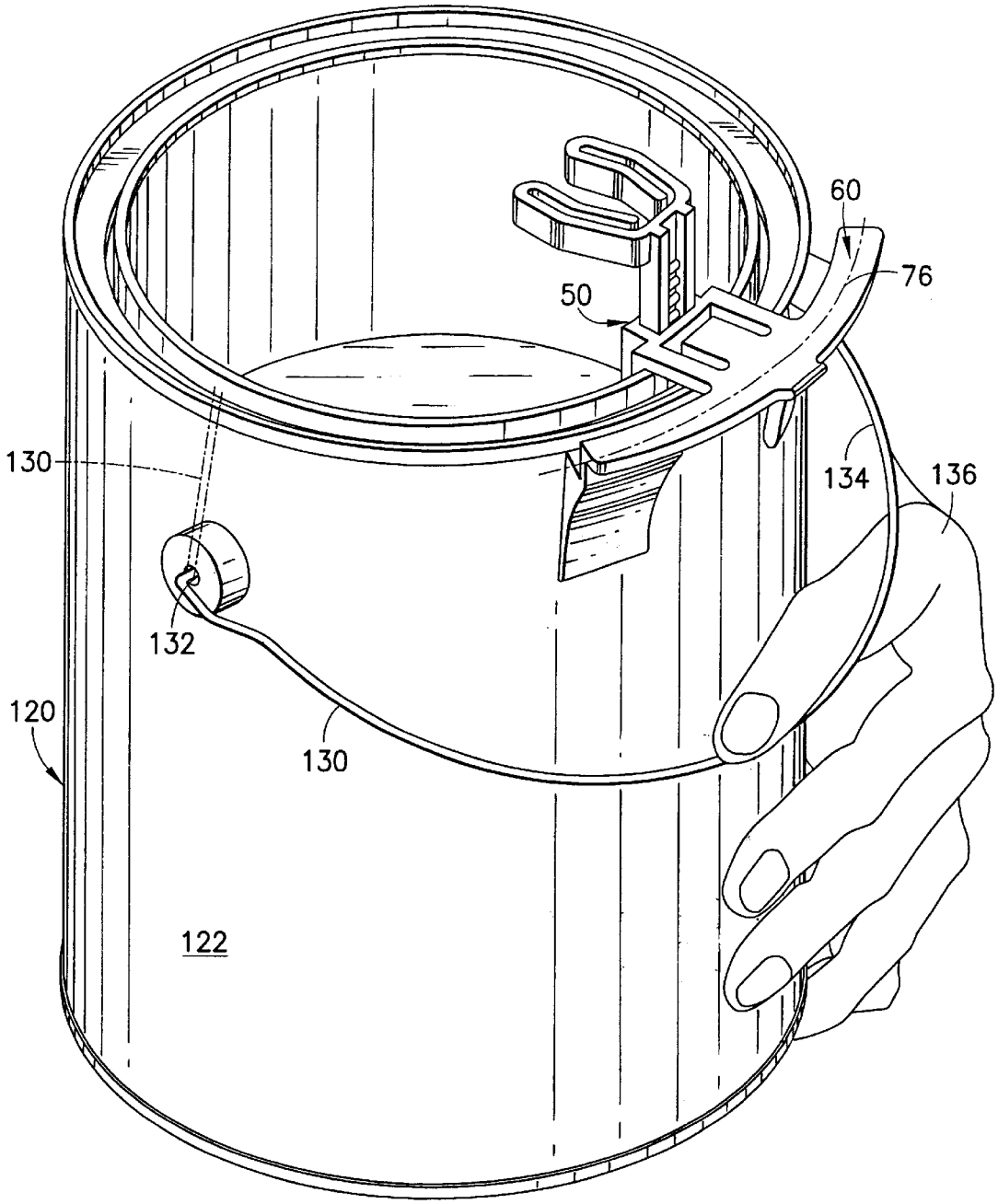
FIG. 7 is a pictorial perspective view showing the paint brush holder attached to a paint container during a painting operation.
Figure 8:
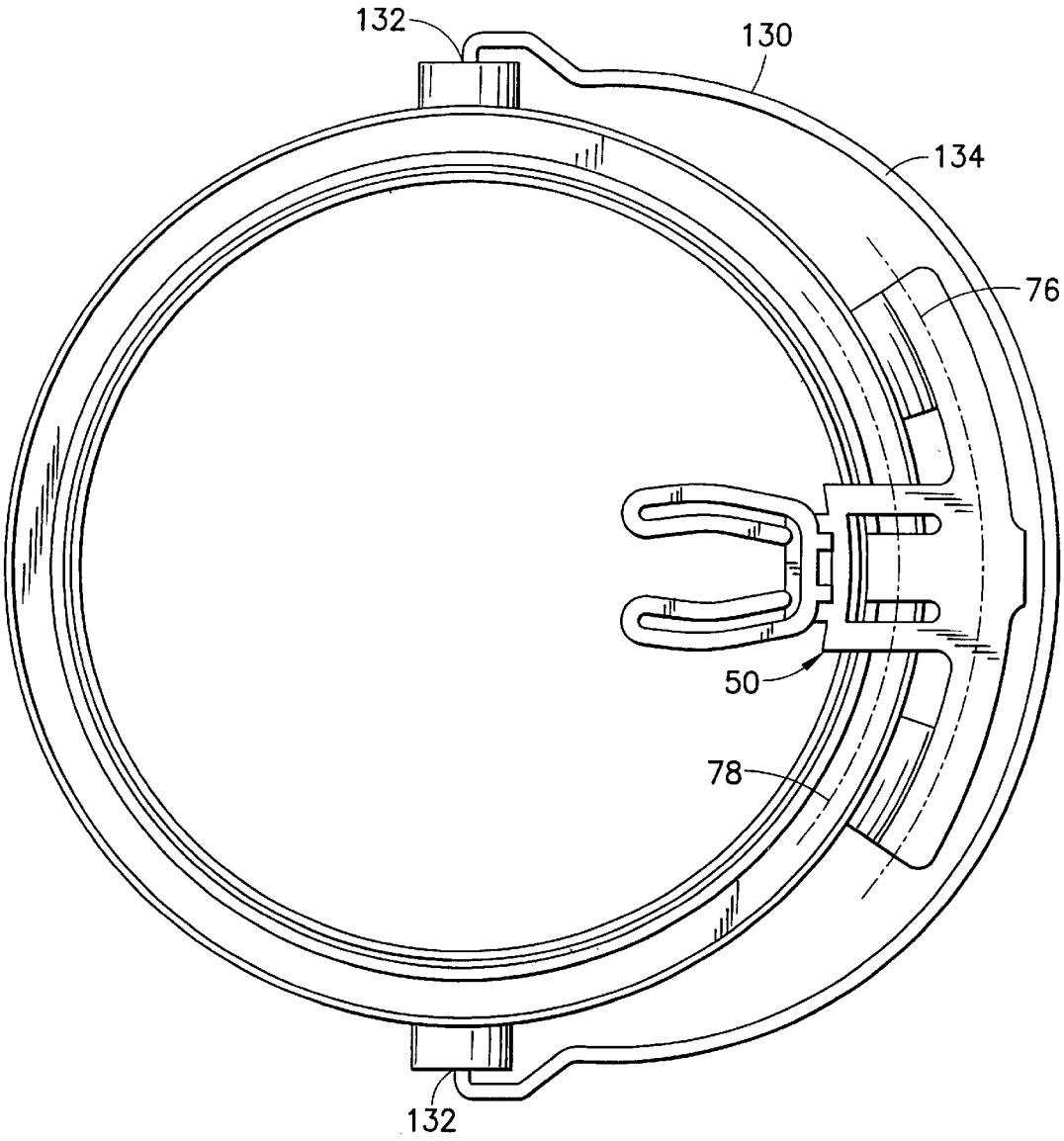
FIG. 8 is a top plan view of the paint brush holder and paint container of FIG. 7.

Referring now to FIGS. 7 and 8, a conventional one-gallon paint can 120 having an exterior surface 122 is seen to include a bail 130 attached to the exterior surface 122 at diametrically opposite attachment points 132. Bail 130 extends along a prescribed loop 134. During a painting operation an individual's hand 136 will grip the paint can 120 and the bail 130 as shown in FIG. 7. In order to enable such gripping, the basal member 60 of the paint brush holder 50 extends along the basal curve 76 a distance less than the circumferential distance between the attachment points 132 and extends laterally so as to always fall within the loop 134 of the bail 130. In this manner, the bail 130 is able to clear the paint brush holder 50 when the bail 130 is moved between a vertical carrying position, shown in phantom, and the lowered gripping position shown in full lines. Thus, the paint brush holder 50 remains in place upon the can 120 without interfering with the painting operation.

It will be seen that the present invention attains all of the objects and advantages summarized above, namely: Provides a paint brush holder having a construction adapted for attachment to any one of the several commonly available paint container configurations without requiring modification of the paint brush holder structure; enables secure and stable attachment of the paint brush holder to a container with ease while allowing ready selective detachment; does not interfere with the conduct of normal painting operations; holds a paint brush in a desired vertical orientation over the interior of a paint container at an altitudinal elevation selected in accordance with the level of paint in the container so as to enable suspension of the brush above the paint or, if immersion is desired, to assure appropriate immersion of the bristles of the brush without unwanted bending of the bristles or submersion of the brush handle; provides a brush holder constructed of a minimal number of component parts which are readily manufactured and easily assembled for use in the field; attains ease of use and subsequent clean-up through simplified component parts which are easily assembled for use and disassembled subsequent to use; allows ease of packaging and distribution for enhanced and economical distribution and sale; provides a rugged construction capable of exemplary performance over a long service life.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A paint brush holder for attachment to any one container of several containers encountered in the field to hold a paint brush suspended in a generally vertical orientation over an interior of the one container, each container having an essentially cylindrical wall with a curved rim following a curve along the cylindrical wall, an exterior surface and an interior surface, the paint brush holder being adapted for attachment to the one container at the curved rim of the one container and to conform to variations encountered in the curve of the rim among the several containers, the paint brush holder comprising:

a basal member extending longitudinally and having altitudinally depending clamp jaws located along a basal curve generally concentric with the curve of the rim of the container, and a support extending laterally for location over the interior of the container when the basal member is placed over the curved rim of the container, the basal member including a central portion having longitudinally opposite sides, and a resiliently flexible arcuate arm projecting from each of the opposite sides to extend along the basal curve from a root at the central portion to a remote tip; and a clip member on the support, the clip member having clip jaws for holding the paint brush in the vertical orientation, the clip jaws extending laterally relative to the support for suspending the paint brush over the interior of the container;

the clamp jaws including first clamp jaws spaced apart along the basal curve for engaging one of the interior and exterior surfaces of the container, and at least one second clamp jaw located along the basal curve for engaging the other of the interior and exterior surfaces, the first clamp jaws being located one each adjacent the tip of each arcuate arm, and the second clamp jaw being located at the central portion of the basal member such that the resilient flexibility of the arcuate arms enables conformance of the basal member to the variations encountered in the curve at the rim among the several containers and the first and second clamp jaws will attach the basal member securely in place along the curved rim of the one container.

2. The invention of claim 1 wherein:

the basal member includes a guideway extending in an altitudinal direction through the support;

the clip member includes a shaft depending altitudinally from the clip jaws, the shaft being generally complementary to the guideway for being received within the guideway for sliding movement in altitudinal directions within the support; and the paint brush holder includes complementary selective securing elements on the support and on the shaft for securing the shaft within the support with the clip jaws at a selected altitudinal location so as to place the brush at a selected altitudinal elevation within the interior of the container.

3. The invention of claim 2 wherein the complementary selective securing elements include a first detent element on the support and complementary detent elements spaced altitudinally along the shaft for selective engagement with the first detent element to secure the shaft with the clip jaws at the selected altitudinal elevation.

4. The invention of claim 3 wherein the clamp jaws include a pair of outer clamp jaws spaced apart circumferentially along the basal curve for engaging one of the interior and exterior surfaces of the container and an inner clamp jaw intermediate the outer clamp jaws for engaging the other of the inner and outer surfaces.

5. The invention of claim 4 wherein at least the outer clamp jaws are curved essentially concentric with the basal curve.

6. The invention of claim 4 wherein at least the inner clamp jaw is curved essentially concentric with the basal curve.

7. The invention of claim 4 wherein the outer clamp jaws and the inner clamp jaw are curved essentially concentric with the basal curve.

8. The invention of claim 1 wherein the first clamp jaws comprise outer clamping jaws for engaging the exterior surface of the one container and the second clamp jaw comprises an inner clamping jaw for engaging the interior surface of the one container.

9. The invention of claim 8 wherein the outer clamp jaws are curved essentially concentric with the basal curve.

10. The invention of claim 9 wherein the inner clamp jaw is curved essentially concentric with the basal curve.

11. The invention of claim 9 wherein the basal member includes laterally spaced apart inner and outer edges, the outer clamping jaws are located along the outer edge and the inner clamping jaw is located along the inner edge.

12. The invention of claim 11 wherein the outer clamping jaws include barbed elements for engaging the rim of the container adjacent the exterior surface of the container.

13. The invention of claim 12 wherein the inner clamping jaw includes a further barbed element for engaging the rim of the container adjacent the internal surface of the container.

14. The invention of claim 1 wherein the container includes a bail attached to the external surface at diametrically opposite attachment points and extending along a prescribed loop, and the basal member extends along the basal curve a circumferential distance less than the distance between the attachment points, and extends laterally so as to fall within the loop of the bail when the basal member is attached to the container.

15. The invention of claim 1 wherein the basal member is constructed of a one-piece member of synthetic polymeric material.

16. Then invention of claim 1 wherein the basal member is constructed of a one-piece first member of synthetic polymeric material, and the clip member is constructed of a one-piece second member of synthetic polymeric material.

* * * * *